US007621001B2

(12) United States Patent
Ebihara

(10) Patent No.: US 7,621,001 B2
(45) Date of Patent: Nov. 24, 2009

(54) POCKET PROVIDED WITH FASTENER

(76) Inventor: Kenzo Ebihara, 2-4-28, Wado, Miyashiro-machi, Minami-saitama-dun, Saitama (JP) 345-0836

( * ) Notice: Subject to any disclaimer, the term of this patent is extended or adjusted under 35 U.S.C. 154(b) by 142 days.

(21) Appl. No.: 11/653,893

(22) Filed: Jan. 17, 2007

(65) Prior Publication Data

US 2007/0226878 A1 Oct. 4, 2007

(30) Foreign Application Priority Data

Mar. 30, 2006 (JP) ..... 2006-093833

(51) Int. Cl.
*A41D 27/20* (2006.01)

(52) U.S. Cl. ..... 2/247

(58) Field of Classification Search ..... 2/247, 2/249, 250, 251, 252; 24/11 HC, 3.1, 3.12, 24/3.13, 3.5; 206/3
See application file for complete search history.

(56) References Cited

U.S. PATENT DOCUMENTS 699,425 A * 5/1902 Strauss ..... 2/249
2,823,434 A * 2/1958 Buren, Jr ..... 24/3.1
3,212,689 A * 10/1965 Woolfolk ..... 206/3
4,334,326 A * 6/1982 Mallow ..... 2/249
5,248,308 A * 9/1993 von Emster ..... 604/337
6,954,945 B2 10/2005 Ebihara
7,007,352 B1 * 3/2006 Hill ..... 24/522
2002/0157170 A1 * 10/2002 Lipscher ..... 2/250

* cited by examiner

*Primary Examiner*—Gary L Welch
*Assistant Examiner*—Amber R Anderson
(74) *Attorney, Agent, or Firm*—Wenderoth, Lind & Ponack, L.L.P.

(57) ABSTRACT

A pocket provided with fastener includes a pocket formed by a base cloth and an outer cloth disposed atop the base cloth whose bottom and both lateral side portions are sewed to the base cloth, a top portion thereof being open so as to create a pocket portion; and a fastener detachably provided on the outer cloth, with at least one attachment hole for mounting the fastener formed in the outer cloth. The fastener includes a planar base portion; a mounting belt portion one end of which is fixedly mounted on the planar base portion for detachable attaching the fastener to the pocket through the attachment hole; a fastening projecting portion that projects above the base portion and fastens an object to be fastened; and a lid member that opens and doses to maintain a state in which the object to be fastened is fastened to the fastening projecting portion.

16 Claims, 4 Drawing Sheets

POCKET PROVIDED WITH FASTENER

BACKGROUND OF THE INVENTION

1. Field of the Invention

The present invention relates to a pocket provided with a fastener capable of retaining small objects such as the strap of a cell phone, eyeglasses, or the like.

2. Related Art

Conventionally, as a garment pocket for containing a small object such as a cell phone or the like, U.S. Pat. No. 6,954,945 entitled "Article-dropping proof pocket for garments" is known. The pocket in question has a storage portion provided on the garment cloth and an open portion provided above the storage portion, and is constructed so as to be able to dose the pocket with a cover cloth provided on the storage part, so that the storage part is dosed with the cover cloth and an object stored in the pocket does not fly out or fall out even when a person wearing the garment bends over or moves violently.

However, with this type of conventional garment pocket, although it has the distinctive feature that an object stored therein does not fly out, it does not have the capability to retain small objects such as the strap of a cell phone, eyeglasses, or the like.

SUMMARY OF THE INVENTION

Accordingly, the present invention has as its object to provide a pocket with the capability to retain securely and simply the strap of a cell phone or a variety of other small objects.

To achieve the above-described object, the present invention provides a pocket with fastener, comprising a pocket formed by a base cloth and an outer cloth disposed atop the base cloth whose bottom and both lateral side portions are sewed to the base cloth, a top portion thereof being open so as to create a pocket portion and a fastener detachably provided on the outer cloth. At least one attachment hole for mounting the fastener is formed in the outer cloth. The fastener comprises a planar base portion; a mounting belt portion one end of which is fixedly mounted on the planar base portion for detachably attaching the fastener to the pocket through the attachment hole; a fastening projecting portion that projects above the base portion and fastens an object to be fastened; and a lid member that opens and doses to maintain a state in which the object to be fastened is fastened to the fastening projecting portion.

Preferably, a holding hole that penetrates the outer cloth is formed at a position near the opening of the outer cloth. The strap of a cell phone or other storage object may then be passed through the holding hole and the front end of the strap attached to the fastening projecting portion, thus securing the strap in place so that the storage object does not move much but remains stable.

Preferably, upper edge portions of the holding hole are formed as attachable-detachable overlapping flaps so as to open and dose the holding hole. Such a construction facilitates insertion and extraction of the strap into and out of the holding hole.

Preferably, the outer cloth attachment hole is comprised of two slits that extend parallel to each other a predetermined interval apart in a horizontal direction beneath the holding hole, a cloth strip backing that is sewn onto the inside of the outer cloth surrounds both slits and separates both slits from the pocket portion so as to attach the fastener to the pocket by passing the mounting belt portion of the fastener through both slits without being exposed to the pocket portion. Such a construction enables the fastener to be mounted in the pocket without exposing the mounting belt portion of the fastener to the interior of the storage portion, since the mounting belt portion is passed through the two slits outside of the storage portion of the pocket, and thus the mounting belt portion and the storage object do not directly contact each other.

Preferably, the fastener lid member is further provided with a semicircular ring member. Such a construction enables eyeglasses and the like to be retained with ease on the semicircular ring member. In addition, by inserting a portion of a storage object stored in the pocket storage portion through this semicircular ring member, the storage object can be made more stable.

Preferably, a front end portion of the mounting belt portion of the fastener and a front surface of the base portion are provided with mutually detachable hooks, which facilitate attachment and detachment of the fastener to and from the pocket. It should be noted that hook-and-loop fastener or other simple means can be used as convenient for the means of attachment to and detachment from the base portion of the mounting belt portion.

The present invention can provide a pocket capable of stably storing a storage object, particularly one like a cell phone that is provided with a strap, in a state in which the object is simply and securely fastened in place.

In addition, by forming a holding hole through which the strap is passed and held the movement of the strap is restricted, thus providing the special effect of stabilizing the object stored in the pocket. By further providing a semicircular ring member, eyeglasses and the like can be securely retained in place.

Other features and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE INVENTION

Figure 1:
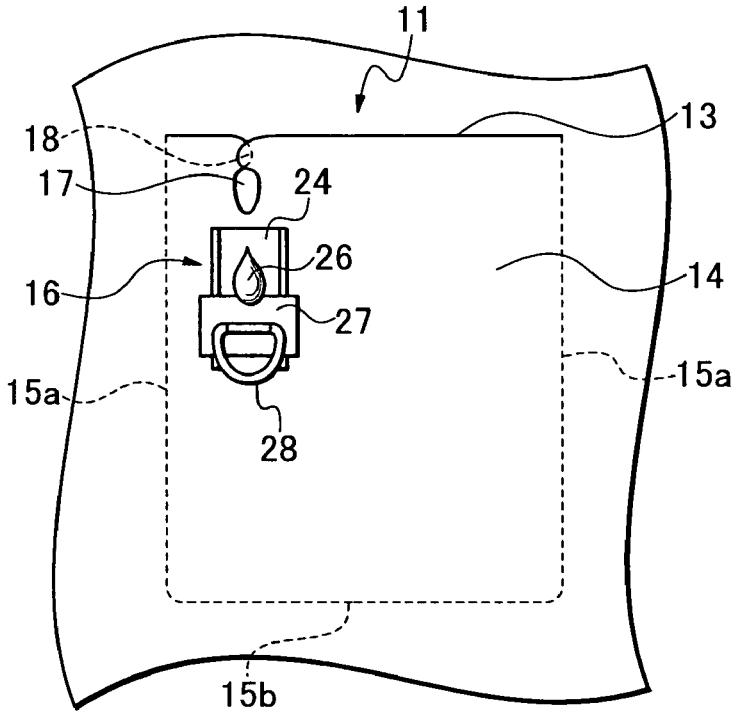
FIG. 1 shows a front view of a pocket provided with a fastener according to an embodiment of the present invention.

A detailed description will now be given of a preferred embodiment of the present invention, with reference to the accompanying drawings.

The drawings show a pocket 11 provided with a fastener according to the present invention. The pocket 11 is composed of a storage part 12 formed by sewing a bottom portion 15*b* as well as left and right edge portions 15*a*, 15*a* of an outer cloth 14 disposed atop a base cloth 15 and forming an open portion 13 at a top portion thereof for storing a storage object, and a fastener 16 detachably provided on the outer cloth 14.

The material that forms the pocket 11 may be a natural fiber, such as cotton, hemp or silk; a synthetic or chemical fiber, such as nylon, polyester, or vinylon; or any material used to make bags, briefcases or garments with pockets, such as leather, fur or synthetic resin material.

Figure 3:
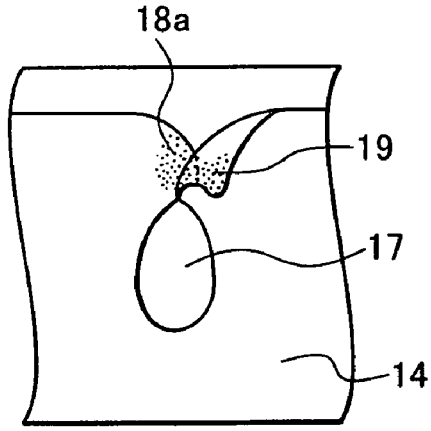
FIG. 3 shows an enlarged front view of a holding hole portion of the pocket.
Figure 4:
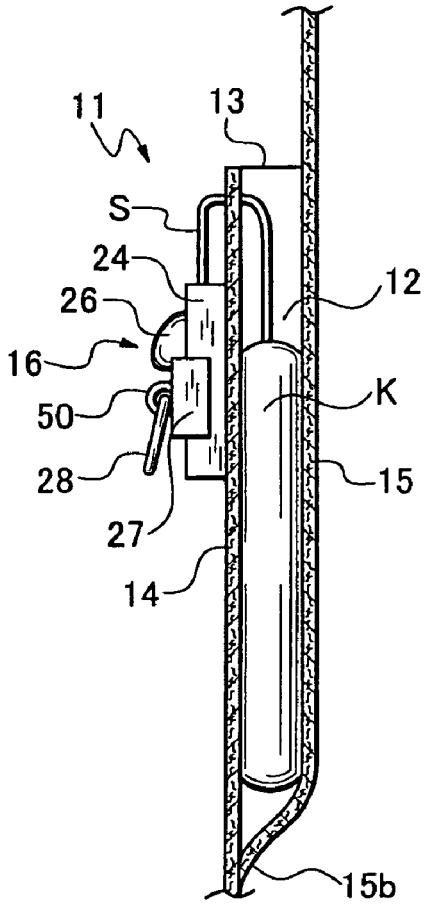
FIG. 4 shows a longitudinal sectional view of a state in which a cell phone is inserted in the pocket.
Figure 5:
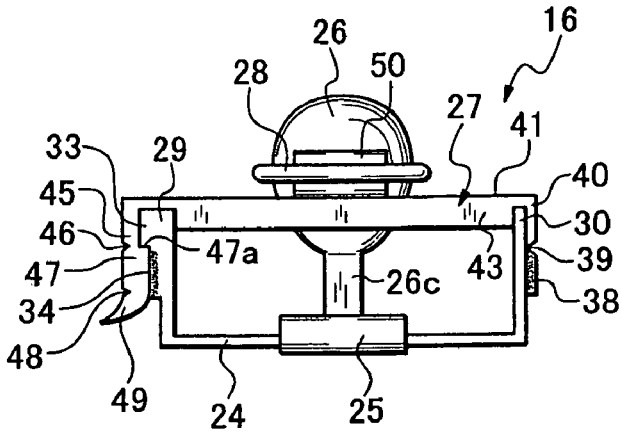
FIG. 5 shows a bottom view of the pocket fastener.

Overlapping flaps 18, 18 cut in curved shapes and forming a holding hole 17 and the upper edge portion of the holding hole 17 are formed at a position near the open portion 13 of the outer cloth 14. A magnet member 18*a* is provided in one of the overlapping flaps 18 and a metal member 19 such as iron powder is provided in the other overlapping flap 18, making the two flaps detachably attachable (see FIG. 3).

In a state in which the overlapping flaps 18, 18 are attached to each other and the holding hole 17 remains closed, a strap S of a cell phone K, for example, can be inserted therethrough and held thereat, such that the strap S does not move laterally as the pocket itself moves and therefore contributing to the stability of the cell phone K when stored inside the storage part 12.

Figure 2:
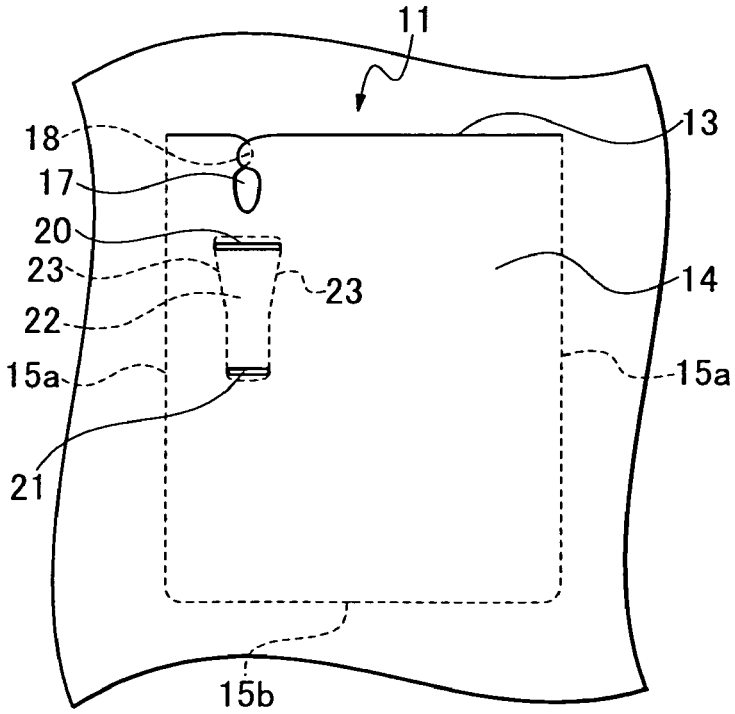
FIG. 2 shows a front view of a state in which the fastener is removed from the pocket.

Two horizontal parallel slits 20, 21 placed a predetermined interval apart are formed below the holding hole 17 in the outer cloth 14 (see FIG. 2). On the inside of the slits 20, 21 a cloth strip backing 22 is sewn along sewing attachment lines 23 so as to enclose the slits 20, 21. These slits 20, 21 are used to insert and retain a part of the fastener 16 to be described later.

The fastener 16 is composed of a base portion 24 made of synthetic resin and U-shaped in cross-section; a belt portion 25 fixedly mounted on a top end portion of the base portion 24, extending along a rear surface thereof and around a bottom end thereof, a front end of which fastens to a front surface side thereof; a fastening projecting portion 26 that projects toward the front surface side of the base portion 24; and a lid member 27 that opens and closes along the lower edge of the fastening projecting portion 26.

Projecting portions 29 and 30 projecting to a predetermined height are formed on both end portions of the base portion 24. Two sets of notched portions 31, 31 and 32, 32 into which upper and lower ends of the lid member 27 are inserted are formed at predetermined locations on the projecting portions 29 and 30 spaced a predetermined interval apart (see FIG. 7). Between notched portions 31, 31 a thickened portion 33 of predetermined thickness is provided on and along the edge of projecting portion 29, together with a step portion 33*a* (see FIG. 6). In addition, a magnet member 34 of predetermined length is provided along a side surface of the step portion 33*a*.

Figure 6:
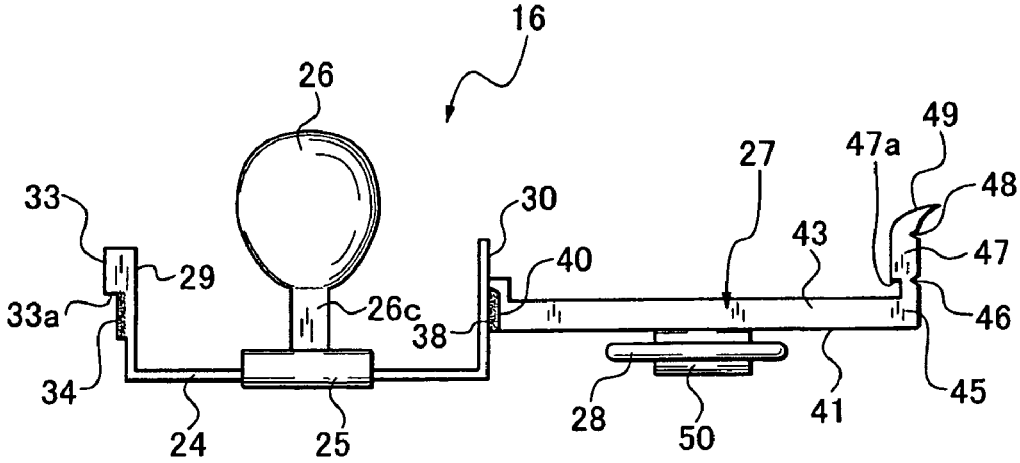
FIG. 6 shows a bottom view of a state in which a lid member of the fastener is open.
Figure 7:
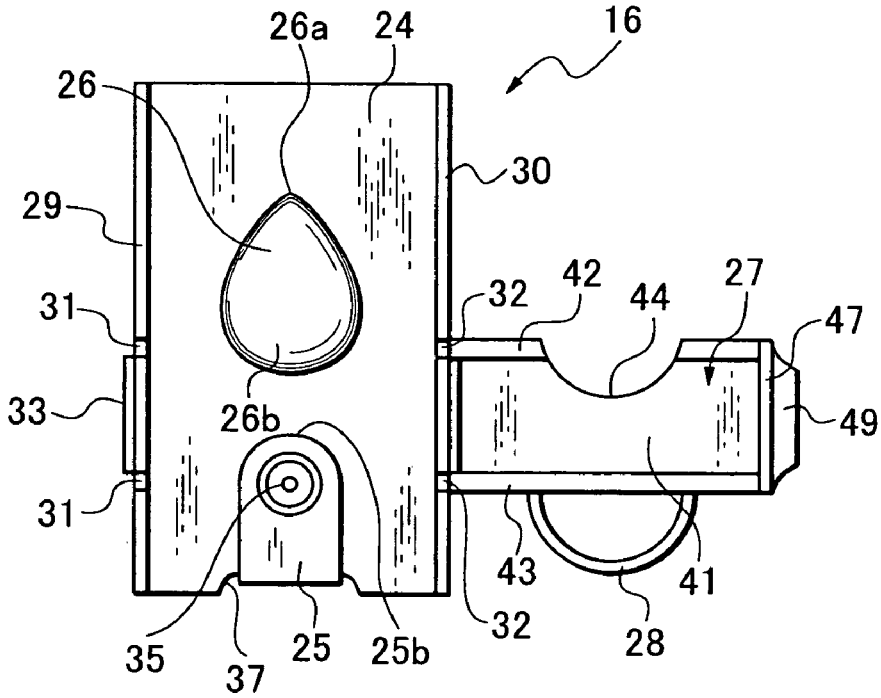
FIG. 7 shows a front view of a state in which the lid member of the fastener is open.
Figure 8:
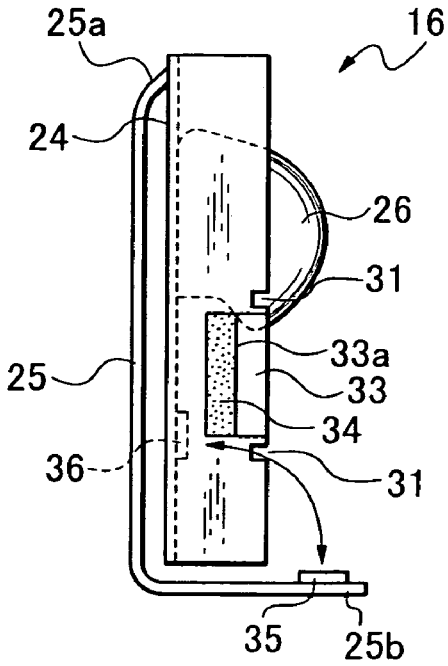
FIG. 8 shows a left lateral side view of a state in which the lid member of the fastener is open.

The fastening projecting portion 26 is formed from a step portion 26*c* on the base portion 24 side that retains the strap S of the cell phone K or the like, and a head portion of which a top portion 26*a* side is formed to an acute angle and which expands toward both sides and a bottom side to prevent slippage (see FIGS. 6-8).

It should be noted that the fastening projecting portion 26 is not limited to the shape described above, and may of course be any of a variety of shapes as well as colors. Imparting to the fastening projecting portion 26 a variety of designs improves the fashionableness of the fastener 16.

The belt portion 25 is made of flexible synthetic resin and formed in a belt-like shape, with a base end portion 25*a* thereof mounted on the top rear surface of the base portion 24. The belt portion 25 has an intermediate portion of reduced width and is formed rather narrowly, with a female hook 35 provided on a front-end portion 25*b* thereof. The female hook 35 engages a male hook 36 provided on the front of the base portion 24. It should be noted that a notched part 37 of width wider than the width of the belt portion 25 is formed on the bottom end portion of the base portion 24. Positioning the belt portion 25 in the notched portion 37 prevents the belt portion 25 from sliding in the lateral direction.

The front end portion 25*b* of the belt portion 25 formed as described above is inserted into and through the upper slit 20 and then out through the lower slit 21, where the female hook 35 on the base portion 24 is engaged with the male hook 36 on the front end of the belt portion 25. Such a construction enables the fastener 16 to be detachably attached to the outer cloth 14 of the pocket 11. Therefore, the fastener 16 can be exchanged for any design at will.

The lid member 27 is mounted in such a way as to open and dose across the space between the projections 29, 30 located at both ends of the base portion 24. In other words, one end portion 38 having the magnet is mounted on the outside surface of the notched portions 31, 31 of the projecting portion 30, a fold 39 is formed along the edge of the end portion 38, a side portion 40 is continuous therewith through the fold 39, and a panel portion 41 that extends in a perpendicular direction is formed as a single integrated unit on the side portion 40. A side portion 45 is formed as a single integrated unit with the panel portion 41, at and perpendicular to an end portion of the panel portion 41. The side portion 45 extends downward along the thickened portion 33 of the projecting portion 29. A fold 46 is formed along an edge of the side portion 45 and a side portion 47 continuous therewith through the fold 46.

The side portion 47 is thickened, with a step portion 47*a* formed on the inside thereof. The step portion 47*a* is shaped so as to engage the step portion 33*a* of the thickened portion 33 of the projecting portion 29. In addition, iron or other such metal powder is disposed on the inside of the side portion 47, such that the side portion 47 and the magnet member 34 of the projecting portion 29 attract, thus keeping the lid member 27 dosed.

Further, a grip flange 49 is provided on the front-end side of the side portion 47 through the fold 48. Grasping the grip flange 49 enables the lid member 27 to be opened. In addition, iron or other such metal powder is disposed on the side portion 40 as well. When the lid member 27 is opened as shown in FIG. 6, the side portion 40 and the end portion 38 attract each other at the fold 39, thus keeping the lid member 27 open.

A projection 42 and a projection 43 of predetermined width are provided along both top and bottom end portions of the panel portion 41. When the lid member 27 is closed, the projection 42 and the projection 43 engage the notched portion 31 and the notched portion 32, respectively. Therefore, the lid member 27 does not slide downward when dosed.

A semicircular notch 44 that traces the edge of the lower portion 26*b* of the fastening projecting portion 26 is formed in the top end portion of the panel portion 41 (see FIG. 7). Therefore, when the strap S is fastened to the fastening projecting portion 26 and the lid member 27 is closed, the edge portion of the notch 44 acts as a catch, preventing the strap S from slipping off the fastening projecting portion 26.

A semicircular ring member 28 to which small objects such as eyeglasses can be fastened is provided on the lower end side of the lid member 27. The semicircular ring member 28 is mounted on the panel portion 41 via a mounting member 50 (see FIG. 6). It should be noted that even when eyeglasses or the like are fastened to the semicircular ring member 28 the projection 42 and the projection 43 are inserted into the notched portion 31 and notched portion 32, respectively, and therefore the lid member 27 does not slide downward.

The pocket provided with fastener of the present invention can be used with garments such as suits, dress shirts, polo shirts, blouses, overalls, pants and the like, as well as bags such as shoulder bags, handbags, briefcases, travel bags, knapsacks and the like.

As many apparently widely different embodiments and variations of the present invention can be made without departing from the spirit and scope thereof, it is to be understood that the present invention is not limited to the specific embodiments thereof described herein but rather only to the extent set forth in the following claims.

What is claimed is:

1. A pocket with fastener, comprising:

a pocket formed by a base cloth, and an outer cloth disposed atop said base cloth, said outer cloth having lateral side portions secured to said base cloth such that said pocket has an open top portion, said outer cloth having at least one attachment hole formed therein; and a fastener comprising a planar base portion, a mounting belt portion having first and second ends, said first end of said mounting belt portion being fixed to said planar base portion, and said mounting belt portion being removably inserted through said at least one attachment hole of said outer cloth to detachably secure said fastener to said pocket, a fastening projecting portion projecting from said planar base portion for receiving a strap of an object to be fastened to said pocket by said fastener, a lid member movably mounted to said planar base portion for movement between a closed position in which the strap, when received on the fastening projecting portion, is retained on said fastening projecting portion by said lid member, and an open position in which the strap, when received on the fastening projecting portion, can be removed from said fastening projecting portion;

wherein a holding hole is formed through said outer cloth near said open top portion of said pocket to hold the strap and restrict lateral movement of the strap;

wherein said holding hole is defined, at an upper edge thereof, by mutually overlapping flaps that are detachably attached to one another such that the overlapping flaps are movable between a closed condition in which said overlapping flaps are overlapped and engaged with each other so as to provide the holding hole with a closed periphery to retain the strap therein, and an open condition in which said overlapping flaps are disengaged from each other so as to cause the holding hole to have an open periphery that opens through an upper edge of said outer cloth at said open top portion of said pocket so that the strap can be inserted and removed from said holding hole;

wherein said planar base portion has first and second lateral sides, and a pair of projections projecting forwardly from said first and second lateral sides; and wherein said lid member comprises a panel portion that, in said closed position of said lid member, spans across said pair of projections.

2. The pocket with fastener, according to claim 1, wherein said lateral side portions of said outer cloth are secured to said base cloth by being sewn thereto.

3. The pocket with fastener, according to claim 2, wherein said mutually overlapping flaps are respectively provided with a magnet and a magnetically attractable member, such that, in said closed condition of said overlapping flaps, said overlapping flaps are retained in said closed condition by mutual attraction of said magnet and said magnetically attractable member.

4. The pocket with fastener, according to claim 3, wherein said at least one attachment hole comprises a pair of mutually parallel slits formed in said outer cloth, said slits being horizontally disposed and spaced apart from each other, and being located below said holding hole.

5. The pocket with fastener, according to claim 4, wherein a cloth strip backing is sewn onto a side of said outer cloth inside said pocket so as to surround both of said slits and separate said slits from said pocket such that said fastener is fastenable to said pocket by having said mounting belt portion passed though both slits without being exposed to said pocket.

6. The pocket with fastener, according to claim 2, wherein said at least one attachment hole comprises a pair of mutually parallel slits formed in said outer cloth, said slits being horizontally disposed and spaced apart from each other, and being located below said holding hole.

7. The pocket with fastener, according to claim 6, wherein a cloth strip backing is sewn onto a side of said outer cloth inside said pocket so as to surround both of said slits and separate said slits from said pocket such that said fastener is fastenable to said pocket by having said mounting belt portion passed though both slits without being exposed to said pocket.

8. The pocket with fastener, according to claim 1, wherein said mutually overlapping flaps are respectively provided with a magnet and a magnetically attractable member, such that, in said closed condition of said overlapping flaps, said overlapping flaps are retained in said closed condition by mutual attraction of said magnet and said magnetically attractable member.

9. The pocket with fastener, according to claim 8, wherein said at least one attachment hole comprises a pair of mutually parallel slits formed in said outer cloth, said slits being horizontally disposed and spaced apart from each other, and being located below said holding hole.

10. The pocket with fastener, according to claim 9, wherein a cloth strip backing is sewn onto a side of said outer cloth inside said pocket so as to surround both of said slits and separate said slits from said pocket such that said fastener is fastenable to said pocket by having said mounting belt portion passed though both slits without being exposed to said pocket.

11. The pocket with fastener, according to claim 7, wherein said at least one attachment hole comprises a pair of mutually parallel slits formed in said outer cloth, said slits being horizontally disposed and spaced apart from each other, and being located below said holding hole.

12. The pocket with fastener, according to claim 11, wherein a cloth strip backing is sewn onto a side of said outer cloth inside said pocket so as to surround both of said slits and separate said slits from said pocket such that said fastener is fastenable to said pocket by having said mounting belt portion passed though both slits without being exposed to said pocket.

13. The pocket with fastener, according to claim 1, further comprising a semicircular ring member mounted to said lid member of said fastener.

14. The pocket with fastener, according to claim 1, wherein said planar base portion and said second end of said mounting belt portion are respectively provided with detachably engageable first and second engagement members to removably fix said second end of said mounting belt portion to said planar base portion.

15. The pocket with fastener, according to claim 14, wherein both said fastening projecting portion and said first engagement member are provided on a front face of said planar base portion so as to face forwardly.

16. The pocket with fastener, according to claim 1, wherein said lid member further comprises first and second side portions respectively engageable with said projections when said lid member is in said closed position.

* * * * *